United States Patent [19]

Robinson

[11] Patent Number: 4,468,675

[45] Date of Patent: Aug. 28, 1984

[54] SHORTENED ANTENNA WITH COAXIAL TELESCOPING CYLINDERS

[76] Inventor: Lawrence P. Robinson, Mobile Home Manor, 2756 E. Grand River Ave., East Lansing, Mich. 48823

[21] Appl. No.: 318,011

[22] Filed: Nov. 4, 1981

[51] Int. Cl.[3] ..... H01Q 9/14; H01Q 1/10

[52] U.S. Cl. ..... 343/828; 343/908

[58] Field of Search ..... 343/790, 791, 802–804, 343/806, 807, 825–828, 831, 908, 745, 850, 846, 847, 901, 915, 873, 711, 713, 723

[56] References Cited

U.S. PATENT DOCUMENTS

| | | | |
|---|---|---|---|
| 2,486,597 | 11/1949 | Greene | 250/33 |
| 2,531,476 | 11/1950 | Schriefer | 343/790 |
| 2,724,052 | 11/1955 | Boyer | 343/831 |
| 2,972,146 | 2/1961 | Saxe | 343/749 |
| 2,996,718 | 8/1961 | Foley | 343/825 |
| 3,165,748 | 1/1965 | Woloszczuk | 343/792.5 |
| 3,167,775 | 1/1965 | Guertler | 343/806 |
| 3,358,286 | 6/1970 | Heins | 343/750 |
| 3,588,903 | 6/1971 | Hampton | 343/873 |
| 3,871,000 | 3/1975 | Tymann | 343/791 |
| 3,967,276 | 6/1976 | Goubau | 343/828 |
| 4,119,970 | 10/1978 | Bogner et al. | 343/727 |
| 4,366,485 | 12/1982 | Hodgkinson | 343/791 |

*Primary Examiner*—Eli Lieberman
*Assistant Examiner*—Michael C. Wimer
*Attorney, Agent, or Firm*—John J. Swartz

[57] ABSTRACT

An antenna comprising a plurality of axially extending, radially spaced, electrically conductive coaxial cylinders and mechanism electrically coupling opposite ends of said cylinders to the adjacent opposite ends of alternate adjacent cylinders.

16 Claims, 4 Drawing Figures

SHORTENED ANTENNA WITH COAXIAL TELESCOPING CYLINDERS

BACKGROUND OF THE INVENTION

1. Field of the Invention

This invention relates to an antenna, and more particularly to a physically shortened antenna including a conductor having a plurality of folds to permit operation within a limited space.

2. Description of the Prior Art

Antennas generally comprise a conductor or a system of conductors used either for radiating electromagnetic energy into space or for collecting electromagnetic energy from space. Since it is difficult to radiate large amounts of power efficiently in the lower frequency ranges with shortened antennas, it is especially important that as much of the available signal at the transmitter be converted into radiated energy as possible, and that as much of the radiated energy as possible be picked up at the receiver.

A half-wave length conductor is the simplest of the radiating elements. Considerable radiation occurs in this element because of its resonant characteristics and its ability to store large amounts of energy in induction fields. Resonance causes high voltage and high circulating currents and they, in turn, produce strong fields around the antenna. It should be understood that due to resistance of the wire, the movement of waves along an entire wire is somewhat slower than wave movement in space. Wave length on a wire, therefore, is slightly less than that of a wave travelling in space. Physically, an antenna is about 6% shorter than a half-wave travelling in space. This phenomena is sometimes referred to as "end effect".

A quarter-wave grounded antenna is a common type of grounded antenna. This type is called a Marconi antenna as contrasted with a half-wave ungrounded dipole antenna, which is sometimes called a Hertz antenna. The input impedance to the Marconi antenna is approximately 37 ohms when the antenna is fed at its base. In addition, a quarter-wave Marconi is resonant and displays zero reactance as does a half-wave antenna. This assumes that the conducting plane is a perfect conductor. If it is not a perfect conductor, as is the usual case, some of the conditions just discussed would be altered. The conducting plane might be the skin of an aircraft or the frame of an automobile. With ground equipment, the conducting plane is the earth's surface or an artificial ground called a counterpoise.

Energy may be fed to an antenna in a variety of ways. When the exitation energy is introduced to the antenna at the point of high circulating currents, the antenna must be center-fed. When the energy is introduced at the point of maximum voltage, the antenna must be voltage fed.

A folded dipole is a full length conductor that is folded to form a half-wave element. It consists of a pair of half-wave elements connected together at the ends. In it, the voltage at the ends of each element, must be the same. In operation, the field from the driven element induces a current in the second element. This current is the same as the current in the driven element.

Quarter-wave vertical antennas are usable over a narrow band of frequencies around resonance. When it is necessary to modify the electrical length, the electrically short antenna may be lengthened by adding series inductance; the electrically long antenna may be shortened by adding series capacitance. Although the feed impedance or radiation resistance of a quarter-wave length vertical grounded antenna is 36 ohms, higher impedance is available by advancing upwards from ground potential along the length of the antenna. Thus, one point might be a feed point for a 36-ohm line, while a point somewhat higher up along the antenna would serve as a feedpoint for a 52-ohm line. Of course, ground is one of the connections for the transmission line in both instances.

With the conventional antennas utilized heretofore, available space may preclude their use. Vertical grounded antennas have been "shortened" by adding an electrically conductive sphere at the upper end thereof to provide additional capacitance. The use of such a "capacitance ball" does not always provide a satisfactory alternate.

Although in some instances, it is important that antennas, such as radar antennas, have directivity, i.e., an antenna that radiates more energy in one direction than another, other applications require that the antenna be non-directional, isotropic or omni-directional. Accordingly, it is an object of the present invention to provide a new and novel omni-directional antenna.

A further object of the present invention is to provide an antenna, including a plurality of cylindrical antenna sections which are selectively coupled in series circuit relation to provide a variable length antenna having a selected length which is a multiple or sub-multiple of a quarter-wave length at a selected operational frequency.

Still another object of the present invention is to provide an antenna, including a plurality of folded antenna sections which can be selectively coupled to provide a total length of antenna which is a multiple or sub-multiple of a quarter-wave length of the operating frequency.

A still further object of the present invention is to provide an antenna of the type described, including mechanism for mechanically controlling the length of the antenna by means of telescoping antenna sections.

Still another object of the present invention is to provide an antenna, including a plurality of variable length antenna folds which can be tuned to different frequencies by changing the physical lengths of selected folds.

A further object of the present invention is to provide an antenna, including a plurality of coaxial, radially spaced, axially extending, current conducting, different length cylinders which are selectively coupled together.

A still further object of the present invention is to provide an antenna, including a plurality of radially spaced antenna elements each including a pair of radially spaced antenna segments each of which includes telescoping cylinders which can be adjusted to tune the antenna to different wavelengths.

Other objects and advantages of the present invention will become apparent to those of ordinary skill in the art as the description thereof proceeds.

SUMMARY OF THE INVENTION

An antenna comprising a plurality of axially extending, radially spaced, elongated electrical conductors each having a circumferential extent different than the circumferential extent of the adjacent conductors, and mechanism electrically coupling opposite ends of each conductor to the adjacent opposite ends of alternate adjacent conductors.

BRIEF DESCRIPTION OF THE DRAWINGS

The present invention may more readily be understood by reference to the accompanying drawings, in which.

DESCRIPTION OF THE PREFERRED EMBODIMENT

Figure 1:
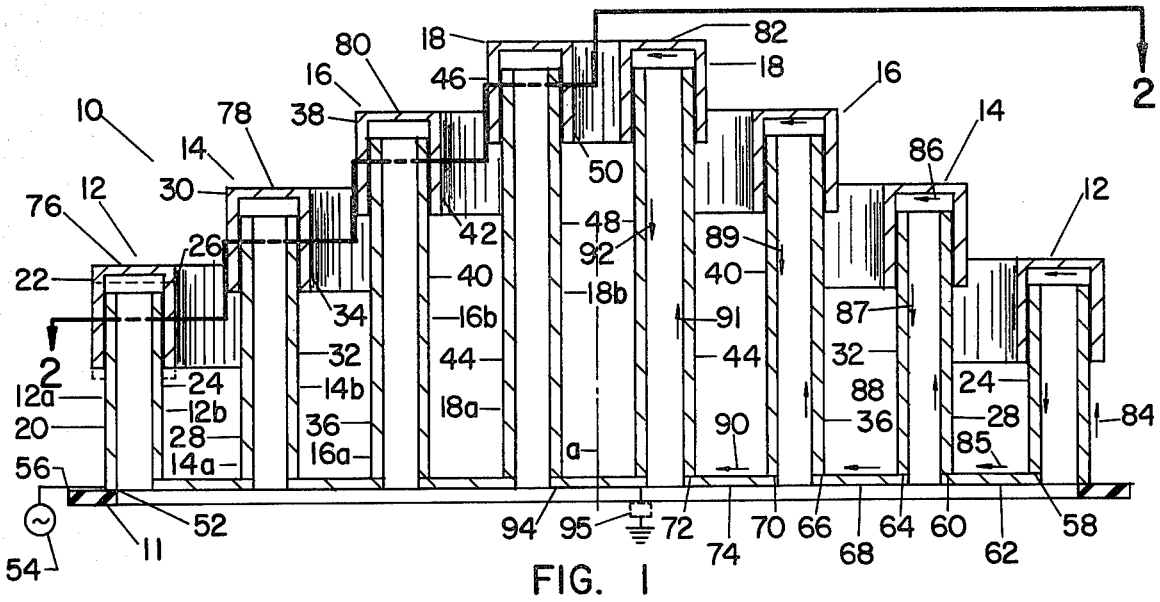
FIG. 1 is an axial sectional view, taken along the line 1—1 of FIG. 2.

Referring now more particularly to the drawing, an antenna constructed according to the present invention, generally designated 10, includes a plurality of radially spaced, axially extending, co-axial antenna elements, generally designated 12, 14, 16 and 18. The radially outermost antenna element 12 of antenna 10 is mounted on an insulated plate or base 11. Each of the antenna elements 12, 14, 16 and 18, include a pair of radially spaced, variable length, antenna segments designated by the numerals 12*a*, 12*b*; 14*a*, 14*b*; 16*a*, 16*b*; 18*a*, 18*b*, respectively.

It should be noted that the axial lengths of antenna segments 12*a* and 12*b* are equal; the axial lengths of antenna segments 14*a* and 14*b* are equal; and the axial lengths of antenna segments 16*a* and 16*b* are equal; and the axial lengths of antenna segments 18*a* and 18*b* are equal.

The antenna segment 12*a* includes a pair of radially outer, electrically conductive, hollow, right circular tubular cylinders 20 and 22 telescopically mounted in sliding engagement. The cylinder 20 is mounted on the insulated base 11. The radially inner antenna segment 12*b* includes a pair of electrically conductive, hollow, axially extending reduced diameter right circular tubular cylinders 24 and 26 telescopically mounted in sliding engagement.

The antenna segment 14*a* includes similar telescopically mounted tubular cylinders 28 and 30 which are substantially identical to the cylinders 24 and 26 respectively, with the exception that the diameters of cylinders 27 and 30 are less than the diameters of cylinders 24 and 26 respectively and the axial length of cylinder 28 is greater than the axial length of the cylinder 24. The antenna segment 14*b* includes telescoping cylinders 32 and 34 which, except for a reduced diameter, are identical to the cylinders 28 and 30 respectively.

The antenna segment 16*a* includes similar tubular telescoping cylinders 36 and 38 which are identical to the cylinders 32 and 34, with the exception that the diameters of cylinders 36 and 38 are less than the diameters of cylinders 32 and 34 respectively and the axial length of the tubular cylinder 36 is greater than the axial length of the cylinder 32. The antenna segment 16*b* includes a similar further reduced diameter tubular cylinders 40 and 42 which are otherwise identical to the tubular elements 36 and 38 respectively.

The antenna segment 18*a* includes tubular cylinders 44 and 46 which are identical to the tubular cylinders 40 and 42, with the exception that the diameters of cylinders 44 and 46 are less than the diameters of tubular cylinders 40 and 42 respectively and tubular cylinder 44 is longer than the tubular cylinder 40.

The antenna segment 18*b* includes tubular cylinders 48 and 50 which with the exception of a still further reduced diameter are identical to the tubular cylinders 44 and 46.

The cylinders of the respective antenna elements 12, 14, 16 and 18 are coaxially mounted on the base 11 about a longitudinal axis a. The material for the antenna elements which can suitably comprise copper should be chosen from such stock that the base impedance should be close to 52 ohms at the resonant frequency.

The lowermost (as illustrated in FIG. 1) axial end 52 of the radially outermost cylinder 20 is coupled to a source of high frequency signals 54 via a conductor 56.

The lower axial end 58 of the tubular cylinder 24 is coupled to the lower end 60 of the radially inner, adjacent tubular cylinder 28 via an annular, electrically conductive ring 62. The lower axial end 64 of the tubular cylinder 32 is coupled to the lower end 66 of the tubular cylinder 36 via an electrically conductive reduced diameter annular web or ring 68. The lower axial end 70 of the tubular cylinder 40 is coupled to the lower axial end 72 of the cylinder 44 via an annular, electrically conductive web 74.

The upper (as illustrated in FIG. 1) axial ends of the coaxial cylinder 22 and 26 are electrically coupled via an electrically conductive annular ring 76. The upper axial ends of the coaxial cylinders 30 and 34 are coupled via a reduced diameter annular, electrically conductive ring 78. The upper axial ends of the cylinders 38 and 42 are electrically coupled via an electrically conductive, still further reduced diameter annular ring 80. The axially upper ends of the cylinders 46 and 50 are coupled via a still further reduced diameter electrically conductive annular ring 82.

The coupling rings 62, 68, 74, which may suitably comprise electrically conductive material such as copper, serially couple the antenna elements 12, 14, 16 and 18, which may also be manufactured from electrically conductive material such as copper, in series circuit relation. The coupling rings 62, 68, 74, 76, 78, 80 and 82 are so arranged that the opposite ends of the coaxial, radially spaced antenna segments 12*b*, 14*b*, 16*b* and 18*b* are connected to the adjacent opposite ends of the next adjacent antenna segment. For example, the coupling ring 76 couples the upper end of antenna segment 12*b* to the upper end of the antenna segment 12*a*, whereas the coupling ring 62 couples the lower axial end of the antenna segment 12*b* to the lower axial end of the antenna segment 14*a*. This arrangement serially couples the antenna segments 12*a*, 12*b*, . . . 18*a*, 18*b* to provide a continuous antenna element.

The axial lengths of the antenna segments 12*a*, 12*b*, . . . 18*a*, 18*b* are such that when coupled in circuit as illustrated in FIG. 1, the current will flow in the axial paths represented by the arrows 84–92 and the total axial, current conducting length of all of the antenna segments 12*a*, 12*b*, . . . 18*a*, 18*b* may be substantially equal to one-eighth of the wave length of the lowest operating frequency provided by the signal source 54. The lowermost end 52 of the copper cylinder 20 will be the high current point and the lowermost end 94 of the innermost cylinder 48 will be the high voltage point in the circuit. If desired, a small condensor 95, illustrated in chain lines in FIG. 1, may be coupled between the high voltage point 94 and the ground plane.

The effective electrical length of the antenna may be mechanically adjusted by merely axially sliding any selected ones of the pairs of cylinders 22, 26; 30, 34; 38, 42; and 46, 50.

Figure 3:
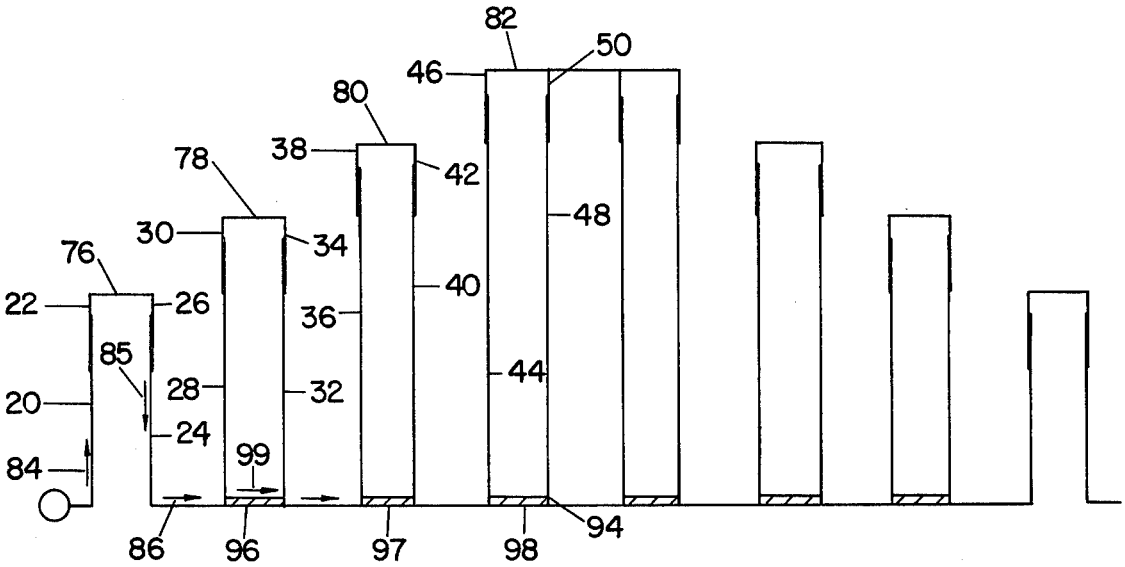
FIG. 3 is a schematic electrical diagram of the antenna illustrated in FIGS. 1 and 2.

Referring now more particularly to FIG. 3, the effective length of the antenna 10 may also be shortened by use of any ones of a plurality of electrically conductive, annular shorting rings 96, 97 and 98 which are selectively inserted into current connecting relation between the lower (as illustrated in FIGS. 1 & 3) axial ends of the cylinders 28 and 32; cylinders 36 and 40, cylinders 44 and 48 respectively. In FIG. 3, all of the shorting rings 96, 97 and 98 are illustrated as being installed between the lower ends of cylinders 30, 34; 38 and 42; and 46, 50 respectively so that the current travels along the paths represented by the arrows 84, 85, 86, 99, to the terminal end 94. When shorting rings 96, 97 and 98 are coupled in circuit as illustrated in FIG. 3 to short circuit the antenna elements 14, 16 and 18, only the antenna element 12 is operative to radiate a signal. When the circuit elements are connected as illustrated in FIG. 1, the current conducting antenna segments **12*a* and 12*b* are of such axial length that the total axial length of the current conducting path represented by the arrows 84 and 85 is substantially equal to one-half of the wave length of the shortest operating frequency of signal source 54. If, only the shorting ring 98 is utilized, the total axial length of the antenna segments 12*a*, 12*b*, 14*b* and 16*b* is such that the radiating element will be substantially equal to one-half of an intermediate operating frequency of the signal source 54**.

The antenna 10 thus provides a radiating element which has a selectively variable wavelength and can be utilized in a much smaller "window" than could a conventional, grounded quarter-wave length antenna.

Since the cylindrical segments **12*a*, 12*b*, 14*a*, 14*b*, 16*a*, 16*b*, 18*a* and 18*b*** are coaxial, the antenna will be omnidirectional or will radiate equally in all directions. Accordingly, the antenna constructed according to the present invention is particularly well adapted for use where space is a prime factor, such as in automobiles. The antenna constructed according to the present invention provides an antenna which operates over a broad frequency range and is yet relatively inexpensive to manufacture. Tuning and loading of the antenna is effected by changing the physical length of selected antenna segments or by progressively shorting selected antenna segments, or both, depending on the frequency or application.

Figure 2:
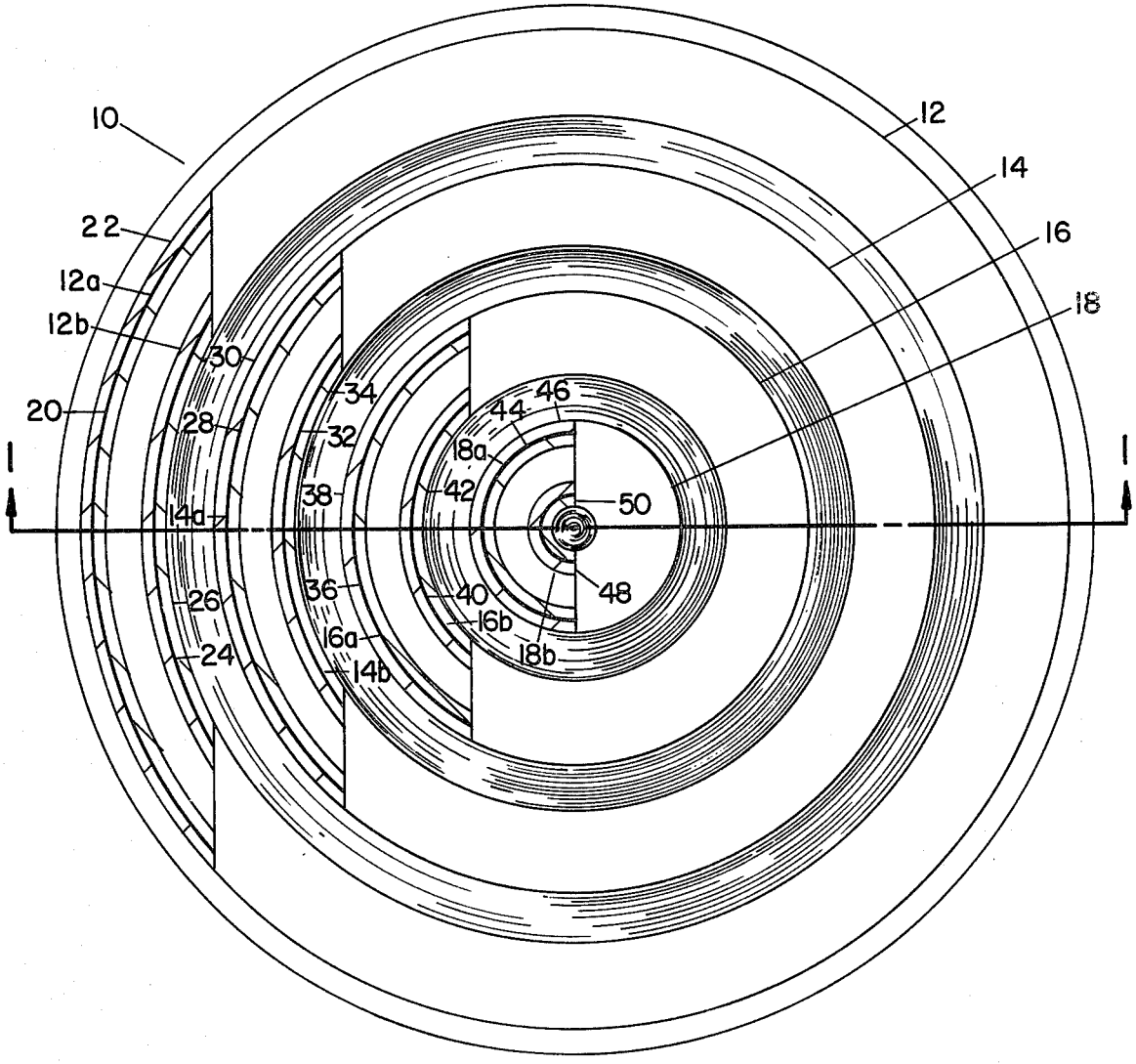
FIG. 2 is a top plan sectional view, taken along the line 2—2 of FIG. 1.
Figure 4:
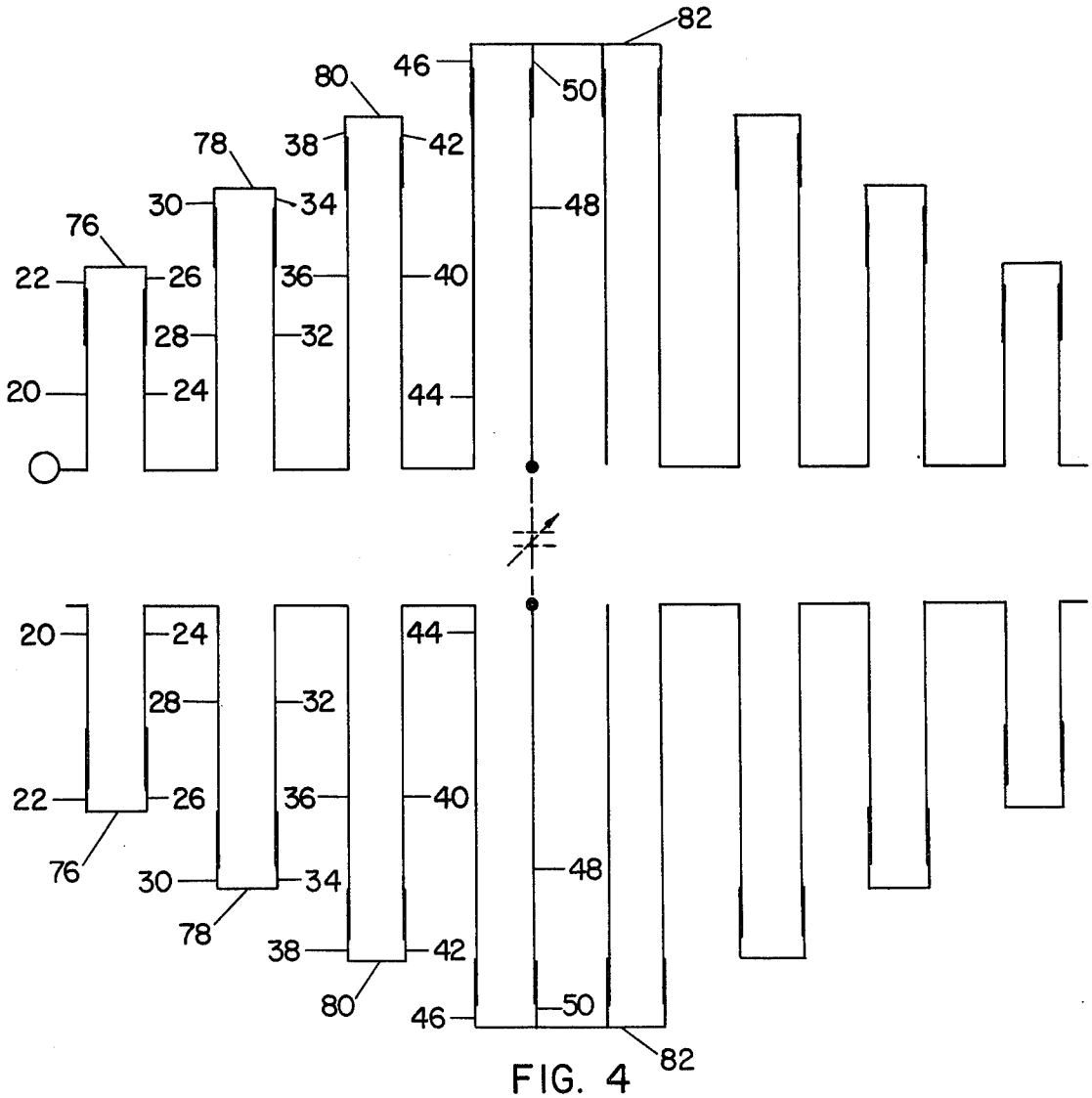
FIG. 4 is a schematic electrical diagram of a slightly modified arrangement of the antenna illustrated in FIGS. 1-3.

FIG. 4 illustrates a dipole arrangement including two antenna halves each identical to the antenna section illustrated in FIGS. 1–3, the innermost high voltage, low current conducting point 94 is coupled to the high voltage point 94 of the opposite identical half of the dipole via a condensor 95.

THE OPERATION

It will be assumed that the source 54 is operating at the lowest frequency. The circuit elements will be positioned as illustrated in FIG. 1 so that the total axial length of the current conducting path through the serially coupled antenna elements is substantially equal to a quarter wavelength of the operating frequency.

If the operating frequency is slightly increased, one or more of the pairs of cylinders 22, 26; 30, 34; 38, 42; and 46, 50 may be moved downwardly (as illustrated in FIG. 1) to reduce the total axial, current conducting length of the antenna 10.

If the operating frequency is still further increased, the shorting ring 98 may be installed between the lower ends of cylinders 44 and 48, as illustrated in FIG. 3, to short circuit the antenna elements 18.

If the source 54 is operating at the highest operative frequency, the shorting rings 96, 97 and 98 are positioned as illustrated in FIG. 3 to short circuit antenna elements 14, 16 and 18 and the cylinders 22 and 26 are axially moved downwardly to the position illustrated in chain lines in FIG. 1 so that the current flows through the shortest axial path along only antenna segments **12*a* and 12*b***.

It is to be understood that the drawings and descriptive matters are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. An antenna comprising:

a plurality of axially extending, radially spaced apart, elongated electrical conductors each having a circumferential extent different than the circumferential extent of the adjacent conductors;

electrically conductive coupling means for coupling opposite ends of each conductor to the adjacent opposite ends of alternate adjacent conductors; and electrically conductive, short circuiting means removably mounted on adjacent ones of selected adjacent conductors;

said coupling means including a plurality of antenna section means telescopingly, slidingly mounted on said conductors for movement between any selected one of a plurality of different positions to selectively increase or decrease the current conducting path of said conductors;

said elongated conductors comprising a plurality of coaxial cylinders;

said coupling means comprising antenna section means telescopingly mounted on adjacent ones of selected cylinders.

2. The antenna set forth in claim 1 wherein said short circuiting means and said antenna section means are mounted on opposite ends of said selected ones of said conductors.

3. The antenna set forth in claim 1 including electrically conductive short circuiting means detachably mounted on selected ones of the cylinders which telescopingly mount said antenna section means.

4. The antenna set forth in claim 3 wherein said antenna section means comprises an annular U-shaped ring.

5. An antenna comprising:

a plurality of axially extending, radially spaced, antenna elements, each comprising:

a pair of radially spaced, variable length, antenna segments, each of said segments including:

first and second radially inner, electrically conductive, hollow, axially extending, tubular cylinders telescopically mounted in sliding engagement;

first and second radially oute, electrically conductive, axially extending, hollow tubular cylinders, telescopically mounted in sliding engagement;

first electrically conductive means electrically coupling together the axially outer adjacent ends of said first radially inner cylinder and said first radially outer cylinder of each pair of cylinders; and second electrically conductive means coupling the antenna elements in circuit relation including means electrically coupling the axially outer end of said second radially inner cylinder of each antenna element to the adjacent axially outer adjacent end of said second radially outer adjacent cylinder of the adjacent antenna element.

6. The antenna set forth in claim 5 wherein said second electrically conductive means includes a plurality of different diameter electrically conductive short circuiting elements selectively detachably mounted on the axially outer ends of said second inner and outer cylinders of any selected antenna element.

7. The antenna set forth in claim 5 wherein each pair of segments of each antenna element has an axial length greater than the axial length of the pair of segments of the next adjacent radially outer antenna element.

8. The antenna set forth in claim 7 wherein said antenna elements are coaxial.

9. The antenna set forth in claim 5 wherein said antenna segments are of such axial length that the axial current conducting path through all the antenna segments is substantially equal to one-quarter of the lowest operating frequency; the axial length of the radially outermost pair of antenna segments being such that the axial current conducting path therethrough is substantially equal to one-quarter of the wavelength of the lowest operating frequency.

10. An antenna comprising:

a first plurality of radially spaced apart, axially extending electrically conductive, hollow cylindrical antenna sections, each having a different diameter and being disposed within the cylindrical antenna section having the next larger diameter;

a second plurality of electrically conductive, hollow, spaced apart cylindrical antenna section means telescopically mounted on successive pairs of said first plurality of antenna sections, at one end of said first plurality of antenna sections, for axial sliding movement between any selected one of a plurality of different positions to provide a plurality of radially spaced variable length antenna segments and permit tuning of the antenna to different frequencies; and electrically conductive means electrically coupling the antenna segments in series circuit including means for electrically coupling the other end of alternate ones of said first plurality of cylindrical antenna sections to the other end of the next succeeding, radially inner one of said first plurality of cylindrical antenna sections.

11. An omni-directional antenna comprising:

a plurality of coaxial, radially spaced, electrically conductive, axially extending hollow cylinders each having first and second ends;

means for coupling said first end of the radially outermost cylinder to a source of signals;

electrically conductive means coupling said first and second ends of each cylinder to said first and second ends respectively of alternate adjacent cylinders;

said electrically conductive means including a plurality of concentric, electrically conductive, radially spaced, shorting rings detachably spanning said first ends of selected ones of said cylinders to selectively short circuit any selected ones of said cylinders and tune the antenna to any selected one of a plurality of different frequencies.

12. An antenna comprising:

a first plurality of pairs of radially spaced apart electrically conductive, hollow cylindrical antenna sections, the antenna sections each having a different diameter and being disposed within the cylindrical antenna sections having the next larger diameter;

a second plurality of pairs of radially spaced apart, electrically conductive, hollow cylindrical antenna sections telescopically engageably mounted on one end of said first plurality of pairs of antenna sections for axial sliding movement between any selected one of a plurality of different positions to provide, with said first plurality of antenna sections, a plurality of radially spaced, variable length generally cylindrical antenna segments;

first electrically conductive means electrically coupling the segments of each successive pair of antenna segments together including:

means electrically coupling together the cylindrical sections of each successive pair of said second plurality of cylindrical sections, and second electrically conductive means electrically coupling together the radially innermost one of each of said first plurality of antenna sections in each antenna segment to the adjacent radially outermost antenna section of said first plurality of sections of the adjacent pair of segments; and means for coupling the other end of the radially outermost cylindrical section of said first plurality of pairs of sections to a signal source.

13. An antenna comprising:

a plurality of coaxial, cylindrical antenna elements each including:

a radially inner current conducting cylinder and a radially outer current conducting cylinder;

a current conducting annular web coupling one axial end of the radially outer cylinder to the adjacent axial end of the radially inner cylinder such that current path in said radially inner and outer cylinders will be in opposite directions;

means for coupling the other end of the radially outer cylinder of the radially outermost antenna element to a source of operating signals;

the axial current conducting length of the outermost antenna element from said other end of said radially outer cylinder to the other end of the radially inner cylinder being substantially equal to one-quarter of the wavelength of the highest operating frequency; and means for selectively coupling and decoupling said radially inner cylinder of said radially outermost antenna element in series with any selected ones of the other antenna elements such that the axial current conducting path of the outermost antenna element and the selected elements is one-quarter of the wavelength of any selected one of a plurality of different operating frequencies lower than the highest operating frequency.

14. The antenna set forth in claim 13 wherein said coupling and decoupling means comprises a plurality of different diameter webs coupling the other end of the radially inner cylinder of each antenna element to the other end of the radially inner antenna element, and a plurality of annular shorting rings detachably mounted on and spanning said other ends of said radially inner and outer cylinders of each antenna element.

15. The antenna set forth in claim 13 wherein the length of eacy cylinder of the radially outermost pair of cylinders is one-eight the length of the wavelength of the highest operating frequency.

16. An omni-directional antenna comprising:

a plurality of pairs of coaxial, electrical current conducting cylinders, each successive pair of cylinders being of equal axial length, the axial length of each pair of cylinders being greater than the axial length of the pairs of cylinders radially outwardly thereof;

means serially coupling opposite ends of the cylinders to the adjacent opposite ends of alternate adjacent cylinders; and means coupling one end of one of the cylinders to a source of signals;

said axial lengths of said cylinders being such that the current conducting path through all the cylinders is substantially equal to one-quarter of the wavelength of the lowest operating frequency; the axial length of the first pair of cylinders being such that the current conducting path through said radially outermost pair of cylinders is substantially equal to one-quarter of the wavelength of the highest operating frequency.

* * * * *